United States Patent [19]

Evans

[11] Patent Number: 4,963,276

[45] Date of Patent: Oct. 16, 1990

[54] LUBRICANT COMPOSITION

[75] Inventor: Samuel Evans, Marly, Switzerland

[73] Assignee: Ciba-Geigy Corporation, Ardsley, N.Y.

[21] Appl. No.: 284,568

[22] Filed: Dec. 15, 1988

[30] Foreign Application Priority Data

Dec. 24, 1987 [CH] Switzerland ..... 5055/87

[51] Int. Cl.[5] ..... C10M 135/26; C10M 135/28

[52] U.S. Cl. ..... 252/47.5; 252/48.2; 252/48.6; 252/48.8; 252/50; 252/78.1; 252/404; 252/405; 252/406

[58] Field of Search ..... 252/50, 48.6, 48.2, 252/48.8, 78.1, 47.5

[56] References Cited

U.S. PATENT DOCUMENTS

| | | | |
|---|---|---|---|
| 3,041,284 | 6/1962 | Calhoun et al. | 252/48.6 |
| 3,944,492 | 3/1976 | Wheeler | 252/50 |
| 4,248,723 | 2/1981 | Schmidt | 252/48.6 |
| 4,394,279 | 7/1983 | de Vries et al. | 252/50 |
| 4,704,219 | 11/1987 | Shaw | 252/50 |
| 4,737,300 | 4/1988 | Wirth et al. | 252/48.2 |

*Primary Examiner*—Olik Chaudhuri
*Assistant Examiner*—Ellen McAvoy
*Attorney, Agent, or Firm*—Stephen V. O'Brien

[57] ABSTRACT

Composition containing at least one lubricant, for example based on mineral oils, synthetic oils or mixtures thereof or a hydraulic fluid and a mixture of one or more compounds from series (A) and one or more compounds from series (B), the compounds of series (A) having the general formula

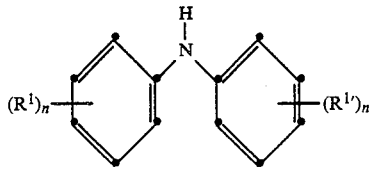

(I)

and the compounds of series (B) having the general formula

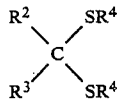

(II)

or

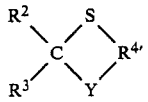

(IIa)

in which the radicals $R^1$ and $R^{1'}$ are, for example, —H or alkyl having 1 to 24 C atoms and n is 0, 1 or 2, $R^2$ and $R^3$ are, for example, —H, alkyl having 1 to 24 C atoms or phenyl or $R^2$ and $R^3$ together are an alkylene group, and $R^4$ is, for example, an alkyl group having 4–18 C atoms or a radical $$-CH_2-\underset{\underset{O}{\|}}{C}-OR^5,$$

in which $R^5$ can be an alkyl group, and $R^{4'}$ is an alkylene group and Y is O or S. The mixture imparts a high stability towards oxidative degradation to lubricant compositions.

18 Claims, No Drawings

LUBRICANT COMPOSITION

The present invention relates to novel lubricant and hydraulic fluid compositions having a high stability towards oxidative degradation.

It is known that additives can be added to lubricants, such as mineral oils or synthetic and semi-synthetic oils, to improve their use properties.

Additives which suppress oxidative degradation of the lubricants and guarantee a high storage stability and stability of action are of great importance.

Today, for example, additives from the diphenylamine series, such as are described in EP-A-No. 0,149,422, are added to the lubricant oils for this purpose.

Thioketals which can be used as high pressure additives in lubricants have moreover been disclosed in DE-OS No. 2,827,253.

Novel lubricant compositions which have properties which are even better than those of the products disclosed to date and are distinguished by a high stability towards oxidative degradation have now been found.

The present invention relates to a composition containing at least one lubricant, in particular based on mineral oil, synthetic oils or mixtures thereof, or a hydraulic fluid and a mixture of one or more compounds from the series (A) and one or more compounds from the series (B), the compounds of series (A) having the general formula

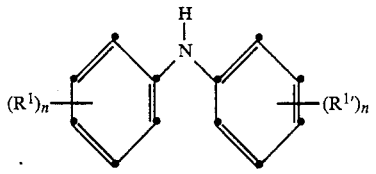

(I)

in which $R^1$ and $R^{1'}$ are identical or different and are —H, alkyl having 1 to 24 C atoms, cycloalkyl having 5 to 12 C atoms or phenyl-($C_1$–$C_4$)alkyl and n is a number from 0, 1 or 2, and the compounds of series (B) having the general formula

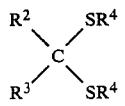

(II)

or

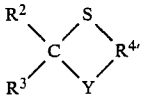

(IIa)

in which $R^2$ is —H, alkyl having 1 to 24 C atoms, phenyl, phenyl which is substituted by $NO_2$, Cl, Br, F, $C_1$–$C_{12}$alkyl and/or $C_1$–$C_{12}$alkoxy, phenyl-($C_1$–$C_4$)alkyl, phenyl of the general formula

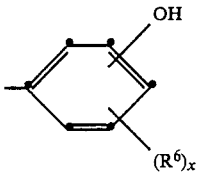

in which $R^6$ is —H, alkyl having 1 to 20 C atoms or phenyl-($C_1$–$C_4$)alkyl and x is 1 or 2, or $R_2$ is furyl, tetrahydrofuryl, 2-methylfuryl, 2-methyltetrahydrofuryl, cyclohexyl or cyclohexenyl which is unsubstituted or substituted by —$CH_3$, or $R^2$ is a group of the formula

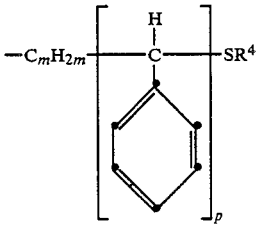

in which m is 1 and p is 0 or 1, or m is 2 and p is 0, and $R^4$ is in each case as defined below, and $R^3$ is —H, alkyl having 1 to 24 C atoms, phenyl, phenyl which is substituted by $NO_2$, Cl, Br, F or $C_1$–$C_{12}$alkyl, phenyl-($C_1$–$C_4$)alkyl or a phenyl radical of the general formula

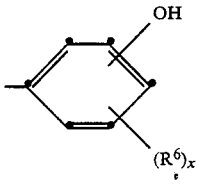

in which $R^6$ and x are as defined above, or $R^3$ is

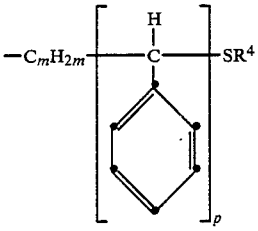

in which m is 1 and p is 0 or 1, or m is 2 and p is 0, or

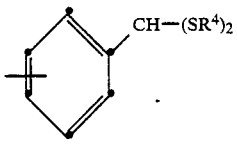

in which $R^4$ is each case as defined below, or $R_2$ and $R_3$ together are a —$CH_2$—$(CH_2)_{2-9}$—$CH_2$ the radicals $R_4$ are identical or different and are alkyl having 4 to 18 C atoms, phenyl, tolyl, benzyl or $$-(CH_2)_s-\underset{\underset{O}{\|}}{C}-OR^5,$$

in which s is 1 or 2 and $R^5$ is alkyl having 1 to 24 C atoms, and $R^{4'}$ is unsubstituted or $C_1$–$C_{12}$alkyl-substituted alkylene having 1 to 18 C atoms and Y is O or S.

The substituents $R^1$, $R^{1'}$, $R^2$, $R^3$ or $R^5$ as alkyl having 1 to 24 C atoms are, for example, methyl, ethyl, propyl, isopropyl, butyl, isobutyl, 2-butyl, t-butyl, pentyl, 1-methylphenyl, isopentyl, hexyl, 1,3-dimethylbutyl, heptyl, 1,1,3,3-tetramethylbutyl, 1-methylhexyl, 3-heptyl, octyl, 2-ethylhexyl, 1-methylheptyl, nonyl, 1,1,3-trimethylhexyl, decyl, undecyl, dodecyl, 1-methylundecyl, tridecyl, tetradecyl, pentadecyl, hexadecyl, heptadecyl, octadecyl, eicosyl and the like.

The above examples apply in the same way to the particular C chain lengths for the alkyl substituents $R^4$ having 4 to 18 C atoms and $R^6$ having 1 to 20 C atoms.

Cycloalkyl $R^1$ or $R^{1'}$ having 5 to 12 C atoms is, for example, a group of the formula $$-HC-(CH_2)_a-CH_2,$$

in which a is a number from 3 to 9.

This cycloalkyl group can be unsubstituted or substituted by $C_1$–$C_4$alkyl. Examples are cyclopentyl, cyclohexyl, methylcyclohexyl, dimethylcyclohexyl, trimethylcyclohexyl, t-butylcyclohexyl, cyclooctyl and cyclododecyl.

The substituent phenyl-($C_1$–$C_4$)alkyl is preferably benzyl.

Finally, $R^2$ or $R^3$ can be phenyl substituted by $C_1$–$C_{12}$alkyl. The examples for $C_1$–$C_{12}$alkyl can be taken accordingly from the above list. Examples are methylphenyl, dimethylphenyl, trimethylphenyl, ethylphenyl, t-butylphenyl, isopropylphenyl, di-t-butylphenyl or 2,6-di-t-butyl-4-methylphenyl.

$R^{4'}$ in formula (IIa) can be alkylene which is unsubstituted or substituted by $C_1$–$C_{18}$alkyl. Examples of this radical are methylene, ethylene, propylene, trimethylene, tetramethylene, pentamethylene, hexamethylene, heptamethylene, octamethylene, decamethylene or dodecamethylene, and furthermore di-1,1-dimethyl-2,2-dimethyldimethylene, 1,1,2-trimethyl-2-n-propyltrimethylene, 2-ethyl-2-n-butyltrimethylene, 1-iso-propyl-2,2-dimethyltrimethylene, 1-methyltrimethylene, 2,2-dimethyltrimethylene, 1,1,3-trimethylene or 2,2,4- or 2,4,4-trimethylhexamethylene. $R^{4'}$ is preferably dimethylene or trimethylene.

In an advantageous embodiment, $R^1$ and $R^{1'}$ in the compounds of the formula I are identical or different and are —H, alkyl having 4 to 12 C atoms, cycloalkyl, and in this case preferably cyclohexyl, or phenyl($C_1$–$C_4$)alkyl.

In a preferred embodiment, $R^1$ and $R^{1'}$ are —H or alkyl having 4 to 8 C atoms.

Mixtures of two or more compounds of the formula I can also be used, in particular, as compounds of series (A). For example, the reaction products obtainable by the process of EP-A-No. 0,149,422 can be used as compounds of series (A). Preferably, the reaction product produced by the process mentioned is used as such. According to the process of this patent specification last mentioned, diphenylamine is reacted with diisobutylene in the presence of a catalyst to give a liquid antioxidant composition by carrying out the reaction of diphenylamine with an excess of diisobutylene in the presence of an active alumina catalyst, keeping the concentration of diisobutylene essentially constant throughout the duration of the reaction, applying a reaction temperature of at least 160° C., carrying out the reaction until the content of 4,4'-di-tert-octyldiphenylamine, based on the reaction mass without the catalyst, is less than 30% by weight, preferably less than 25% by weight, and the content of diphenylamine is less than 10% by weight, preferably less than 5% by weight, removing the catalyst and unreacted diisobutylene and isolating the liquid product formed. A liquid reaction mixture containing 4,4'-di-tert-octyldiphenylamine results from this process. This reaction mixture containing the compounds of series (A) is preferably used, as mentioned, for the mixture together with the compounds from series (B).

Suitable mixtures of compounds of the formula I can contain, for example, in varying proportions:

(b) 4-tert-butyldiphenylamine,
(c) (i) 4-tert-octyldiphenylamine,
(c) (ii) 4,4'-di-tert-butyldiphenylamine,
(c) (iii) 2,4,4'-tris-tert-butyldiphenylamine,
(d) (i) 4-tert-butyl-4'-tert-octyldiphenylamine
(d) (ii) 2,2'- or 2,4'-di-tert-octyldiphenylamine,
(d) (iii) 2,4-di-tert-butyl-4'-tert-octyldiphenylamine,
(e) (i) 4,4'-di-tert-octyldiphenylamine,
(e) (ii) 2,4-di-tert-octyl-4'-tert-butyldiphenylamine.

The mixture of compounds of series (A) of the formula I preferably contains (a) 1 to 5% by weight of diphenylamine,
(b) 8 to 18% by weight of 4-tert-butyldiphenylamine,
(c) 21 to 31% by weight of one or more of the compounds (i) 4-tert-octyldiphenylamine, (ii) 4,4'-di-tert-butyldiphenylamine and (iii) 2,4,4'-tris-tert-butyldiphenylamine,
(d) 20 to 31% by weight of one or more of the compounds (i) 4-tert-butyl-4'-tert-octyldiphenylamine, (ii) 2,2'- or 2,4'-di-tert-octyldiphenylamine and (iii) 2,4-di-tert-butyl-4'-tert-octyldiphenylamine and
(e) 15 to 29% by weight of the compounds (i) 4,4'-di-tert-octyldiphenylamine or (i) 4,4'-di-tert-octyldiphenylamine and (ii) 2,4-di-tert-octyl-4'-tertbutyldiphenylamine.

This mixture is obtainable, in particular, by the process mentioned.

In further advantageous embodiments, the substituent $R^2$ in formula II is —H, alkyl having 1 to 12 C atoms, phenyl, o-hydroxyphenyl, 3,5-di-$R^6$-4-hydroxyphenyl, in which $R^6$ is as defined above, furyl or

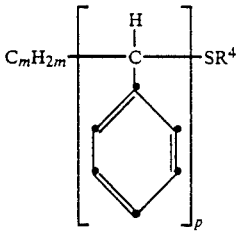

in which m is 1 and p is 0 or 1, or m is 2 and p is 0, and $R^4$ is as defined above.

$R^3$ in formula II is advantageously —H, alkyl having 1 to 12 C atoms or

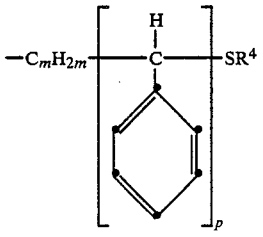

in which m is 1 and p is 0 or 1, or m is 2 and p is 0, and $R^4$ is as defined above.

In an advantageous embodiment, $R^4$ is alkyl having 4 to 12 C atoms, phenyl or

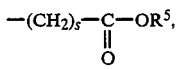

in which $R^5$ is alkyl having 1 to 18 C atoms or, preferably, alkyl having 8–13 C atoms and s is 1 or 2.

The substituents $R^4$ are advantageously in each case identical in compounds of the formula II.

Finally, the especially preferred compounds of the formula II include those in which $R^2$ is —H, alkyl having 1 to 8 C atoms, furyl or phenyl, and then compounds in which $R^3$ is —H, alkyl having 1 to 8 C atoms or

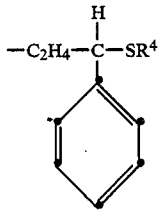

in which $R^4$ is as defined above. $R^4$ is preferably alkyl having 8 to 12 C atoms or

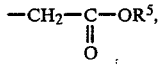

in which $R^5$ is branched alkyl having 8 to 13 C atoms and in particular tert-butyl or 2-ethylhexyl.

Compounds from the series (B) can be used as individual compounds or as a mixture of different compounds from series (B) with one another, in each case mixed with a compound of the series (A) or a mixture of compounds of series (A).

As mentioned, the lubricant composition accordingly contains a mixture of at least one compound from series (A) of the formula I and at least one compound from series (B) of the formula II.

Mixtures of 1 to 9 parts by weight of the compound or compounds of series (A) with 9 to 1 parts by weight of the compound or compounds of series (B), and preferably 2 to 8 parts by weight of the compound or compounds of series (A) and 8 to 2 parts by weight of the compound or compounds of series (B) are advantageously used.

Mixtures containing, as compounds of series (A), 3 parts by weight of a reaction mixture containing 4,4'-di-tert-octyldiphenylamine and, as the compound of series (B), 7 parts by weight of the compound of the formula

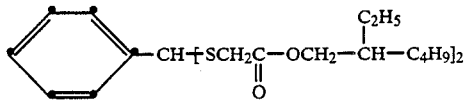

are preferably used.

Mixtures containing, as compounds of series (A), a reaction mixture containing 4,4'-di-tert-octyldiphenylamine and, as the compound of series (B), a compound of the formula

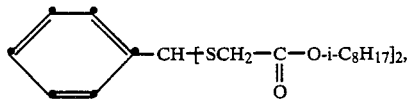

in which i—$C_8H_{17}$ is a mixture of branched isomers having in each case 8 C atoms, in a mixing ratio of (A) to (B) of 9:1 to 1:1 parts by weight are also preferably used. The mixing ratio of (A) to (B) is, in particular, 9:1 or 7:3 or 1:1 parts by weight.

A preferred mixture contains, as compounds of series (A), a reaction mixture containing 4,4'-di-tert-octyldiphenylamine and, as the compound of series (B), a compound of the formula

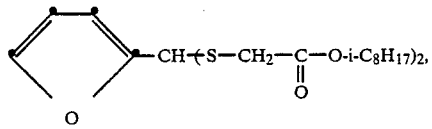

in which i—$C_8H_{17}$ is a mixture of branched isomers having in each case 8 C atoms, in a mixing ratio of (A) to (B) of 9:1 to 1:9 parts by weight.

The mixing ratio of (A) to (B) is, in particular, 9:1 or 3:7 or 1:9 parts by weight.

The compounds of the formula II are known, for example, from Reid, "Organic Chemistry of Bivalent Sulfur", Volume 3, pages 320–341, Chemical Publishing Company, New York, 1960, and can be synthesized in a manner which is known per se. The following reaction routes, for example, are available:

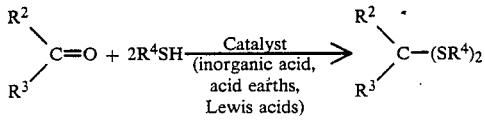

(a)

it being possible for this process to be carried out without a solvent or in a solvent, for example in cyclohexane, toluene, xylene or nitro- or chlorobenzene.

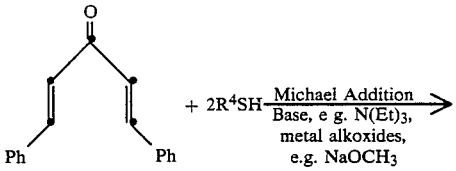

(b)

-continued

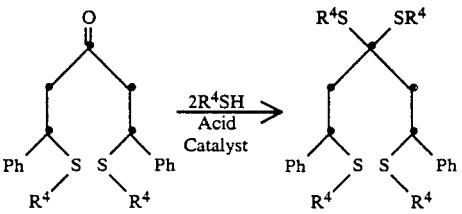

The process can be carried out either without the presence of a solvent or for example, in methanol, ethanol, hexane or toluene as the solvent.

The mixture according to the invention is suitable for addition to lubricants, in particular those based on mineral oils, synthetic oils or semi-synthetic lubricating oils and hydraulic fluids.

Thus, mineral oils, synthetic and semi-synthetic lubricating oils and mixtures thereof and hydraulic fluids which advantageously contain 0.1 to 10% by weight, for example 0.1 to 5% by weight and preferably 0.1 to 1.0% by weight, in each case based on the lubricant or the hydraulic fluid, of a mixture of at least one compound (A) and at least one compound (B) display the desired properties, especially in respect of good resistance towards oxidation.

The possible lubricants are described, for example, in "Ullmanns Enzyklopädie der technischen Chemie (Ullmann's Encyclopaedia of Industrial Chemistry)", Volume 13, pages 85–94 (Verlag Chemie, Weinheim, 1977), in D. Klamann, "Schmierstoffe und verwandte Produkte (Lubricants and Related Products)", Verlag Chemie, Weinheim (1982) or in J. H. Schewe, W. Kobek, "Das Schmiermittel Taschenbuch (The Lubricant Handbook)", Hüthig Verlag, Heidelberg (1974), and are familiar to the expert.

The lubricant can thus be, for example, an oil based on a mineral oil or a synthetic oil, or a grease. The term mineral oil includes all the hydrocarbons. Synthetic oils can be, for example, aliphatic or aromatic carboxylic esters, polymeric esters, polyalkylene oxides, phosphoric acid esters, poly-α-olefins, silicones, glycols, polyglycols or polyalkylene glycols.

The lubricants can also contain other additives, which are added in order to improve the fundamental properties of lubricants still further; these include: other antioxidants, metal passivators, rust inhibitors, agents for improving the viscosity index, agents for reducing the pour point, dispersing agents, detergents, thickeners, biocides, antifoam agents, deand emulsifiers, high pressure additives and agents for reducing friction.

Examples of phenolic antioxidants

1. Alkylated monophenols 2,6-Di-tert-butyl-4-methylphenol, 2,6-di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-iso-butylphenol, 2,6-di-cyclopentyl-4-methylphenol, 2-(α-methylcyclohexyl)-4,6-dimethylphenol, 2,6-di-octadecyl-4-methylphenol, 2,4,6-tricyclohexylphenol, 2,6-di-tert-butyl-4-methoxymethylphenol and o-tert-butylphenol.

2. Alkylated hydroquinones 2,6-Di-tert-butyl-4-methoxyphenol, 2,5-di-tert-butylhydroquinone, 2,5-di-tert-amyl-hydroquinone and 2,6-diphenyl-4-octadecyloxyphenol.

3. Hydroxylated thiodiphenyl ethers 2,2'-Thio-bis-(6-tert-butyl-4-methylphenol), 2,2'-thio-bis-(4-octylphenol), 4,4'-thio-bis-(6-tert-butyl-3-methylphenol) and 4,4'-thio-bis-(6-tert-butyl-2-methylphenol).

4. Alkylidene-bisphenols 2,2'-Methylene-bis-(6-tert-butyl-4-methylphenol), 2,2'-methylene-bis-(6-tert-butyl-4-ethylphenol), 2,2'-methylene-bis-[4-methyl-6-(α-methylcyclohexyl)-phenol] , 2,2'-methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis-(4,6-di-tert-butylphenol), 2,2'-ethylidene-bis-(6-tert-butyl-4-iso-butylphenol), 2,2'-methylene-bis-[6-(α-methylbenzyl)-4-nonylphenol], 2,2'-methylene-bis-[6-(α,α-methylbenzyl)-4-nonylphenol], 4,4'-methylene-bis-(2,6-di-tert-butylphenol), 4,4'-methylene-bis-(6-tert-butyl-2-methylphenol), 1,1-bis-(5-tert-butyl-4-hydroxy-2-methylphenyl)-butane, 2,6-di-(3-tert-butyl-5-methyl-2-hydroxybenzyl)-4-methylphenol, 1,1,3-tris-(5-tert-butyl-4-hydroxy-2-methylphenyl)-3-n-dodecyl-mercaptobutane, ethylene glycol bis-[3,3-bis-(3'-tert-butyl-4'-hydroxyphenyl)-butyrate], bis-(3-tert-butyl-4-hydroxy-5-methylphenyl)dicyclopentadiene and bis-[2-(3'-tert-butyl-2'-hydroxy-5'-methylbenzyl)-6-tert-butyl-4-methyl-phenyl]terephthalate.

5. Benzyl compounds 1,3,5-Tri-(3,5-di-tert-butyl-4-hydroxybenzyl)-2,4,6-trimethylbenzene, bis(3,5-di-tert-butyl-4-hydroxybenzyl) sulfide, isooctyl 3,5-di-tert-butyl-4-hydroxybenzyl-mercaptoacetate, bis-(4-tert-butyl-3-hydroxy-2,6-dimethylbenzyl)-dithiol terephthalate, 1,3,5-tris-(3,5-di-tert-butyl-4-hydroxybenzyl)isocyanurate, 1,3,5-tris-(4-tert-butyl-3-hydroxy-2,6-dimethylbenzyl) isocyanurate, dioctadecyl 3,5-di-tert-butyl-4-hydroxybenzyl-phosphonate and the calcium salt of monoethyl 3,5-di-tert-butyl-4-hydroxybenzyl-phosphonate.

6. Acylaminophenols

4-Hydroxy-lauric acid anilide, 4-hydroxy-stearic acid anilide, 2,4-bis-octylmercapto-6-(3,5-di-tert-butyl-4-hydroxyanilino)-s-triazine and octyl N-(3,5-di-tert-butyl-4-hydroxyphenyl)-carbamate.

7. Esters of 8-(3,5-di-tert-butyl-4-hydroxyphenyl)-propionic acid with alcohols which have one or more functional groups, for example with methanol, diethylene glycol, octadecanol, triethylene glycol, 1,6-hexanediol, pentaerythritol, neopentylglycol, tris-hydroxyethyl isocyanurate, thiodiethylene glycol or bis-hydroxyethyl-oxalic acid diamide.

8. Esters of 8-(5-tert-butyl-4-hydroxy-3-methylphenyl)-propionic acid with alcohols which have one or more functional groups, for example with methanol, diethylene glycol, octadecanol, triethylene glycol, 1,6-hexanediol, pentaerythritol, neopentylglycol, tris-hydroxyethyl isocyanurate, thiodiethylene glycol or di-hydroxyethyl-oxalic acid diamide.

9. Amides of 8-(3,5-di-tert-butyl-4-hydroxyphenyl)-propionic acid for example N,N'-bis-(3,5-di-tert-butyl-4-hydroxyphenylpropionyl)-hexamethylenediamine, N,N'-bis-(3,5-di-tert-butyl-4-hydroxyphenylpropionyl)trimethylenediamine and N,N'-bis-(3,5-di-tert-butyl-4-hydroxyphenylpropionyl)-hydrazine.

Examples of aminic antioxidants

N,N'-Di-isopropyl-p-phenylenediamine, N,N'-di-sec-butyl-p-phenylenediamine, N,N'-bis-(1,4-dimethyl-pentyl)-p-phenylenediamine, N,N'-bis-(1-ethyl-3-methyl-pentyl)-p-phenylenediamine, N,N'-bis-(1-methyl-heptyl)-p-phenylenediamine, N,N'-diphenyl-p-phenylenediamine, N,N'-di-(naphthyl-2)-p-phenylenediamine, N-isopropyl-N'-phenyl-p-phenylenediamine, N-(1,3-dimethyl-butyl)-N'-phenyl-p-phenylenediamine, N-(1-methyl-heptyl)-N'-phenyl-p-phenylenediamine, N-cyclohexyl-N'-phenyl-p-phenylenediamine, 4-(p-toluene-sulfonamido)-diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, 4-n-butylamino-phenol, 4-butyrylamino-phenol, 4-nonanoylamino-phenol, 4-dodecanoylamino-phenol, 4-octadecanoylamino-phenol, di-(4-methoxy-phenyl)amine, 2,6-di-tert-butyl-4-dimethylamino-methyl-phenol, 2,4'-diaminodiphenylmethane, 4,4'-diamino-diphenylmethane, N,N,N',N'-tetramethyl-4,4'-diamino-diphenylmethane, 1,2-di-[(2-methyl-phenyl)-amino]-ethane, 1,2-di(phenylamino)-propane, (o-tolyl)-biguanide, di-[4-(1',3'-dimethyl-butyl)phenyl]amine, tert-octylated N-phenyl-1-naphthylamine, a mixture of mono- and dialkylated tert-butyl/tert-octyldiphenylamines, 2,3-dihydro-3,3-dimethyl-4H-1,4-benzothiazine, phenothiazine and N-allylphenothiazine.

Examples of other antioxidants

Aliphatic or aromatic phosphites, esters of thiodipropionic acid or of thiodiacetic acid, or salts of dithiocarbamic or dithiophosphoric acid.

Examples of metal passivators are for copper, for example: triazoles, benzotriazoles and derivatives thereof, 2-mercaptobenzothiazole, 5,5'-methylenebisbenzotriazole, 4,5,6,7-tetrahydrobenzotriazole, 2,5-dimercaptothiadiazole, salicylidene-propylenediamine and salts of salicylaminoguanidine.

Examples of rust inhibitors are (a) Organic acids and their esters, metal salts and anhydrides, for example: N-oleoyl-sarcosine, sorbitan monooleate, lead naphthenate, dodecenylsuccinic anhydride, alkenylsuccinic acid half-esters and 4-nonylphenoxy-acetic acid.

(b) Nitrogen-containing compounds, for example:

I. primary, secondary or tertiary aliphatic or cycloaliphatic amines and amine salts of organic and inorganic acids, for example oil-soluble alkylammoniumcarboxylates.

II. Heterocyclic compounds, for example: substituted imidazolines and oxazolines.

(c) Phosphorus-containing compounds, for example: amine salts of phosphoric acid partial esters.

(d) Sulfur-containing compounds, for example: barium dinonylnaphthalene-sulfonates and calcium petroleum-sulfonates.

Examples of agents which improve the viscosity index are:

polyacrylates, polymethacrylates, vinylpyrrolidone/-methacrylate copolymers, polyvinylpyrrolidones, polybutenes, olefin copolymers, styrene/acrylate copolymers and polyethers.

Examples of agents which reduce the pour point are:

polymethacrylate and alkylated naphthalene derivatives.

Examples of dispersing agents/surfactants are:

polybutenylsuccinic acid imides, polybutenylphosphonic acid derivatives and basic magnesium, calcium and barium sulfonates and phenolates.

Examples of wear protection additives are:

compounds containing sulfur and/or phosphorus and/or halogen, such as sulfurized vegetable oils, zinc dialkyldithiophosphates, tritolyl phosphate, chlorinated paraffins, alkyl and aryl disulfides, triphenylphosphorothionates, diethanolaminomethyltolyltriazole and di(2-isooctyl)aminomethyltolyltriazole.

The invention also relates to the use of mixtures of compounds of series (B) as an antioxidant in lubricants and hydraulic fluids.

The additives according to the invention are just as effective in lubricant systems of the type described above which additionally contain, however, a co-lubricant system containing customary amounts of solid lubricants, such as graphite, boron nitride, molybdenum disulfide or polytetrafluoroethylene.

The compounds of series (A) and the compounds of series (B) can be mixed with one another in the stated proportions and the mixture can then be admixed in the stated amounts to the lubricant or the hydraulic fluid. It is also advantageous for the compounds of series (A) and the compounds of series (B) to be admixed separately to the lubricant or hydraulic fluid, and in this case also the stated proportions must be observed accordingly. The preparation of so-called master batches is also possible.

The invention is illustrated still further with the aid of the following examples.

All the data in parts and in percentages relate to the weight, unless indicated otherwise.

EXAMPLE 1

(a) Preparation of the thioketal component

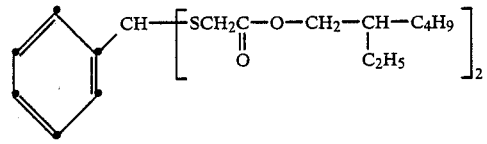

106.1 g of benzaldehyde and 408.7 g of 2-ethylhexyl thioglycolate are initially introduced into 100 ml of toluene, 10 g of bleaching earth (Tonsil L 80 S®) are added and the grey suspension is boiled using a water separator. After the mixture has been boiled under reflux for 45 minutes, water separates off and the suspension becomes pink in colour. After 4 hours, about 17 ml of water (18 ml according to theory) are split off. The batch is allowed to cool to ~80° C., the pink-coloured suspension is filtered off with suction and the solid is washed with a little toluene. The clear golden yellow filtrate is concentrated on a rotary evaporator under about 20 mm Hg and the residue is then dried at 70° C. under a high vacuum of 0.02 mm Hg.

487.6 g, that is to say 98.15% of theory, of a golden yellow oily liquid are obtained. $n_D^{20}=1.518$.

Analysis: 65.22% C, 9.01% H, 12.81% S

-continued

| | | | | |
|---|---|---|---|---|
| Calculated: | 65.28% C, | 8.93% H, | 12.91% S, | 12.88% O |

(b) Preparation of the reaction mixture containing 4,4'-di-tert-octyldiphenylamine:

169.2 g of diphenylamine and 33.8 g of active alumina (Fulcat ® 22B from Laporte Industries) are introduced into a reaction vessel provided with a stirrer and temperature probe and are heated to 165° C. As soon as the mixture has become sufficiently mobile, it is stirred. Thereafter, 196.4 g of diisobutylene are gradually added, so that the temperature of the reaction mixture does not fall below 165° C. The addition takes 5 hours up until the end of the reaction. Reflux starts directly after the start of the reaction. Heating and stirring are continued at 165° C., with frequent sampling, until analysis by gas/liquid chromatography shows a content of 4,4'-di-tert-octyldiphenylamine of less than 25% by weight (without catalyst).

The reaction mass is cooled to 60° C. and the catalyst is removed by vacuum filtration. The filtrate is transferred to a distillation apparatus and the pressure is reduced to 26 mbar, while heating and stirring. During the distillation, the external temperature is allowed to rise slowly to 165° C. and is kept constant at this temperature for 2 hours, during which the distillation stops. 300 g of a viscous dark liquid having a flash point of 210° C. are obtained.

The liquid has the approximate composition of 3.2% by weight of diphenylamine, 13.2% by weight of 4-tert-butyldiphenylamine, 25.3% by weight of compounds from the series comprising 4-tert-octyldiphenylamine, 4,4'-di-tert-butylamine and 2,4,4'-tris-tert-butylamine, 24.2% by weight of compounds from the series comprising 4-tert-butyl-4'-tert-octyldiphenylamine, 2,2'- or 2,4'-di-tert-octyldiphenylamine and 2,4-di-tert-butyl-4'-tertoctyldiphenylamine and 18.2% by weight of 4,4'-di-tert-octyldiphenylamine and 6.0% by weight of 2,4-di-tert-octyl-4'-tertbutyldiphenylamine, as well as further contents of other diphenylamines having a higher degree of alkylation and modified side chains and polymers.

The thioketal compound according to (a) and the reaction mixture according to (b) are mixed with one another in the amounts which can be seen from Example 4. These latter mixtures are admixed in an amount of 0.25% by weight, based on the oil, to a mineral oil of the Mobil 15 SS4 type.

EXAMPLE 2

(a) A thioketal component of the general formula

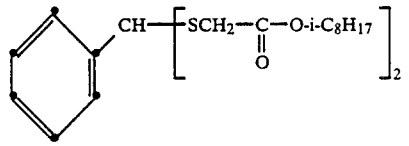

in which i—$C_8H_{17}$ is a mixture of branched isomers, is prepared analogously to (1a).

(b) The reaction mixture containing 4,4'-di-tert-octyldiphenylamine is prepared according to Example (1b).

The thioketal compound according to (a) and the reaction mixture according to (b) are mixed with one another in the amounts which can be seen from Example 4. These latter mixtures are admixed in an amount of 0.25% by weight, based on the oil, to a mineral oil of the Mobil 15 SS4 type.

EXAMPLE 3

(a) A thioketal component of the general formula

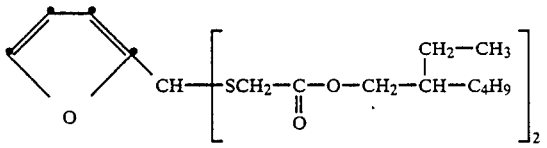

is prepared analogously to Example (1a).

(b) The reaction mixture containing 4,4'-di-tert-octyldiphenylamine is prepared according to Example (1b).

The compounds according to (a) and the reaction mixture according to (b) are brought together in proportions of (a) to (b) of 9:1, 7:3, 1:1, 3:7 and 1:9 parts by weight and are processed to give corresponding mixtures.

EXAMPLE 4

Use of the components in a lubricant composition TOST-TEST, oxidation characteristics of mineral oil (ASTM D934/DIN 51587/IP 157)

The oil to be tested (Mobil 15 SS4) is heated at 95° C. in the presence of water, oxygen, an iron-copper catalyst and the stabilizer for 1,000 hours. The acid value TAN (in mg of KOH consumed per g of test oil) and the SLUDGE (in mg of residue per batch) are then determined. The results are summarized in Table 1. The concentration of the stabilizer mixtures is 0.25% by weight, based on the oil.

TABLE 1

| | Stabilizer (0.25% by weight in total) Mixture of | | 1,000 hours TOST | |
|---|---|---|---|---|
| Example 4 | % by weight according to Example | % by weight according to Example | TAN (mg of KOH/g of oil) | SLUDGE (mg) |
| (a) | 30 (1a) | 70 (1b) | 0.21 | 61 |
| (b) | 70 (1a) | 30 (1b) | 0.21 | 49 |
| (c) | 10 (2a) | 90 (2b) | 0.35 | 22 |
| (d) | 30 (2a) | 70 (2b) | 0.28 | 32 |
| (e) | 50 (2a) | 50 (2b) | 0.26 | 71 |
| (f) | none | none | >2 | >1000 Comparison |

The measurement values from the TOST test for various mixtures of compounds according to Example 3 are shown in the following Table 2. The test method and the conditions are described above, with the exception of the of the test, which is 500 hours, and the oil (mineral oil BB).

TABLE 2

| | Stabilizer (0.25% by weight in total) Mixture of | | 500 hours TOST | |
|---|---|---|---|---|
| Example 4 | % by weight according to Example | % by weight according to Example | TAN (mg of KOH/g of oil) | SLUDGE (mg) |
| (g) | 10 (3a) | 90 (3b) | 0.24 | 58 |
| (h) | 30 (3a) | 70 (3b) | 0.25 | 38 |
| (i) | 50 (3a) | 50 (3b) | 0.11 | 14 |
| (k) | 70 (3a) | 30 (3b) | 0.08 | 27 |
| (l) | 90 (3a) | 10 (3b) | 0.08 | 87 |

What is claimed is:

1. A composition containing at least one lubricant or one hydraulic fluid and a mixture of one or more compounds from series (A) and one or more compounds from series (B), the compounds of series (A) having the general formula

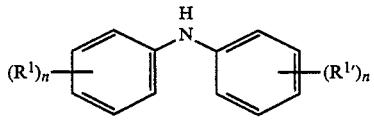

(I)

in which $R^1$ and $R^{1'}$ are identical or different and are —H, alkyl having 1 to 24 C atoms, cycloalkyl having 5 to 12 C atoms or phenyl-($C_1$–$C_4$)alkyl and n is a number 0, 1 or 2, and the compounds of series (B) having the general formula

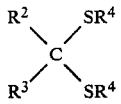

(II)

in which $R^2$ is —H alkyl having 1 to 24 C atoms, phenyl, phenyl which is substituted by $NO_2$, Cl, Br, F, $C_1$–$C_{12}$alkyl or $C_1$–$C_{12}$alkoxy, phenyl-($C_1$–$C_4$)alkyl, phenyl of the general formula

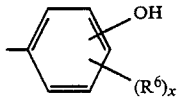

in which $R^6$ is —H, alkyl having 1 to 20 C atoms or phenyl-($C_1$–$C_4$)alkyl and x is 1 or 2, or $R^2$ is cyclohexyl or cyclohexenyl which is unsubstituted or substituted by methyl, and $R^3$ is —H, alkyl having 1 to 24 C atoms, and the radicals $R^4$ are identical or different and are alkyl having 4 to 18 C atoms, phenyl, tolyl, benzyl or $$-(CH_2)_s-\underset{\underset{O}{\|}}{C}-OR^5,$$

in which s is 1 or 2 and $R^5$ is alkyl having 1 to 24 C atoms.

2. A composition according to claim 1, in which the substituents $R^1$ and $R^{1'}$ in formula I are identical or different and are —H, alkyl having 4 to 12 C atoms or cycloalkyl having 5 to 8 C atoms.

3. A composition according to claim 2, in which $R^1$ and $R^{1'}$ are cyclohexyl or phenyl-($C_1$–$C_4$)alkyl.

4. A composition according to claim 2, in which $R^1$ and $R^{1'}$ are —H or alkyl having 4 to 8 C atoms.

5. A composition according to claim 1, in which the compounds of series (A) having the general formula I are a mixture containing (a) 1 to 5% by weight of diphenylamine, (b) 8 to 18% by weight of 4-tert-butyldiphenylamine, (c) 21 to 31% by weight of one or more of the compounds (i) 4-tert-octyl-diphenylamine, (ii) 4,4'-di-tert-butyldiphenylamine and (iii) 2,4,4'-tris-tert-butyldiphenylamine, (d) 20 to 31% by weight of one or more of the, compounds (i) 4-tert-butyl-4'-tert-octyldiphenylamine, (ii) 2,2'- or 2,4'-di-tert-octyldiphenylamine and (iii) 2,4-di-tert-butyl-4'-tert-octyldiphenylamine and (e) 15 to 29% by weight of the compounds (i) 4,4'-di-tert-octyldiphenylamine or (i) 4,4'-di-tert-octyldiphenylamine and (ii) 2,4-di-tert-octyl-4'-tertbutyldiphenylamine.

6. A composition according to claim 1, in which $R^2$ is —H, alkyl having 1 to 12 C atoms, phenyl, o-hydroxyphenyl or 3,4-di-$R^6$-4-hydroxyphenyl wherein $R^6$ is —H, alkyl having 1 to 20 C atoms or phenyl-($C_1$–$C_4$)alkyl.

7. A composition according to claim 1, in which $R^3$ is —H or alkyl having 1 to 12 C atoms.

8. A composition according to claim 1, in which $R^4$ is alkyl having 4 to 12 C atoms, phenyl or $$-(CH_2)_s-\underset{\underset{O}{\|}}{C}-OR^5,$$

in which $R^5$ is alkyl having 1 to 18 C atoms, and s is 1 or 2 and the $R^4$ substituents in formula II are identical.

9. A composition according to claim 1, in which $R^4$ is alkyl having 4 to 12 C atoms, phenyl or $$-(CH_2)_s-\underset{\underset{O}{\|}}{C}-OR^5,$$

in which $R^5$ is alkyl having 1 to 13 C atoms, and s is 1 or 2 and the $R^4$ substituents in formula II are identical.

10. A composition according to claim 9, in which $R^4$ is alkyl having 8 to 12 C atoms or $$-CH_2-\underset{\underset{O}{\|}}{C}-OR^5,$$

in which $R^5$ is branched alkyl having 8 to 13 C atoms.

11. A composition according to claim 10, in which $R^5$ is tert-butyl or 2-ethylhexyl.

12. A composition according to claim 1, in which the substituent $R^2$ is —H, alkyl having 1 to 8 C atoms, furyl or phenyl.

13. A composition according to claim 1, in which $R^3$ is —H, alkyl having 1 to 8 C atoms.

14. A composition according to claim 1, containing a mixture of 1 to 9 parts by weight of at least one of the compounds from series (A) and 9 to 1 parts by weight of at least one of the compounds from series (B).

15. A composition according to claim 1, containing a mixture of, as compounds from series (A), a reaction mixture containing 4,4'-di-tert-octyldiphenylamine and, as the compound from series (B), a compound of the formula

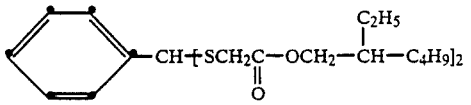

the mixing ratio of (A) to (B) being 3:7 or 7:3 parts by weight.

16. A composition according to claim 1, containing a mixture of, as compounds of series (A), a reaction mixture containing 4,4'-di-tert-octyldiphenylamine and, as compounds of series (B), a compound of the formula

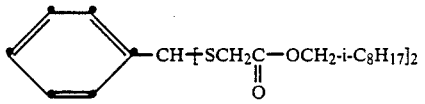

in which i—$C_8H_{17}$ is a mixture of branched isomers having in each case 8 C atoms and the mixing ratio of (A) to (B) is 9:1 to 1:1 parts by weight.

17. A composition according to claim 1, containing 0.1 to 10% by weight, based on the lubricant or the hydraulic fluid, of a mixture of at least one compound of series (A) and at least one compound of series (B).

18. A process for improving the antioxidative properties of a lubricant or a hydraulic fluid by addition of a mixture of compounds of series (A) and compounds of series (B) according to claim 1 to the lubricant or to the hydraulic fluid.

* * * * *